US005223019A

United States Patent [19]

Inazumi et al.

[11] Patent Number: 5,223,019

[45] Date of Patent: Jun. 29, 1993

[54] METHOD AND APPARATUS FOR SINTERING OPERATION

[75] Inventors: Tadahiro Inazumi; Masami Fujimoto; Shuuichi Satou; Keiji Satou, all of Chiba, Japan

[73] Assignee: Nippon Steel Corporation, Tokyo, Japan

[21] Appl. No.: 760,351

[22] Filed: Sep. 16, 1991

[30] Foreign Application Priority Data

Sep. 14, 1990 [JP] Japan ..... 2-242544
Apr. 30, 1991 [JP] Japan ..... 3-124532

[51] Int. Cl.[5] ..... C22B 1/20

[52] U.S. Cl. ..... 75/10.67; 75/758; 266/177

[58] Field of Search ..... 75/10.67, 758, 759; 266/178, 177

[56] References Cited

U.S. PATENT DOCUMENTS 1,508,101 9/1924 Holmberg ..... 75/758
2,911,296 11/1959 Long, Jr. ..... 75/10.67
3,984,230 10/1976 Meunier et al. ..... 75/758

FOREIGN PATENT DOCUMENTS 680722 9/1939 Fed. Rep. of Germany .
2-254125 10/1990 Japan .

OTHER PUBLICATIONS

Tekko Binran II, Seisen Seiko, 3rd Edition, Oct. 15, 1979.

Transactions ISIJ, vol. 24, p. B-35, JP; S. Uno et al., "Application of Magnetic Type FeO-Meter to Sintering Operation".

*Primary Examiner*—Scott Kastler
*Attorney, Agent, or Firm*—Wenderoth, Lind & Ponack

[57] ABSTRACT

A sintering method, which includes igniting a layer of raw materials and providing a downwardly directed air suction is improved by applying a magnetic field to the materials for which a predetermined amount of sintering has been completed in the upper region of the layer of raw materials. The sintering is continued while a magnetic floating force is applied to such sintered cakes. An apparatus for carrying out the method is provided.

22 Claims, 15 Drawing Sheets

METHOD AND APPARATUS FOR SINTERING OPERATION

BACKGROUND OF THE INVENTION

1. Field of the Invention

This invention relates to a method and an apparatus for producing sintered iron ores with a downward air suction flow type sintering machine such as a DL (Dwight-Lloyd) type sintering machine, a GW (Greenawalt) type sintering machine, etc.

2. Prior Art

In a DL sintering process, a sintering reaction proceeds while air is drawn downwardly through the sintering bed and coke contained in the raw materials in the sintering bed is combusted, thereby moving a combustion-melting zone having a thickness of a few mm to a few tens of mm downwardly in the thickness direction of the raw materials in the sintering bed on the pallet, as disclosed in Tekko Binran (Iron & Steel Handbook) II, Seisen Seiko (Pig Iron & Steel Making), third edition, page 106 et seq., compiled by Nihon Tekko Kyokai (Association of Iron and Steel of Japan) and published on Oct. 15, 1979.

In the DL sintering process, the sintering proceeds along with the combustion-melting zone of the sintering bed with the air being drawn through the already sintered cakes in the upper level region being preheated. Thus, the raw materials are liable to undergo sintering in a heat excess state in the combustion-melting zone, whereas the raw materials are liable to undergo sintering in a heat deficient state in the upper level region. Thus, an amount of molten material in the combustion-melting zone is increased in accordance with a heat gradient in the thickness of the layer of raw materials.

In addition, the sintered cakes in the upper level region press downwardly against the combustion-melting zone due to the weight of the formed sintered cakes and also due to a downward force on the sintered cakes created by the suction of a blower. The molten materials under such load are highly liable to clog the pores in the sintering bed, and the necessary permeability conditions for stable combustion of the coke breeze contained in the layer of raw materials are deteriorated in the combustion-melting zone of the sintering bed, resulting in a decrease in the sintering speed. Simultaneously, a lower yield and increased NOx results due to the deterioration of coke breeze combustion. Besides, qualitatively the strength of the sintered ores is lowered and the number of pores is reduced, resulting in poor reducibility.

To solve these problems, it was proposed to improve the permeability by decreasing the layer thickness to reduce the permeability resistance or by using an increased amount of quick lime to intensify granulation of raw materials. However, the former results in lower yield and strength and the latter requires the use of expensive quick lime.

Japanese Patent Application Kokai (Laid-open) No. 2-254125 discloses an effective method for preventing reductions in the yield and quality at a low cost by supporting sintered cakes by the use of stand materials. However, the proposed method still has problems in that they require the periodic replacement of the stand materials used for supporting the sintered cakes, due to abrasion of the stand materials.

SUMMARY OF THE INVENTION

An object of the present invention is to provide a method and an apparatus for a sintering operation capable of stable production of sintered ores of good quality by securing a high productivity and a high yield, while solving the problems of the prior art.

Another object of the present invention is to provide a method and an apparatus for a sintering operation capable of reduced weight operation in a non-contact state by magnetically floating sintered cakes, thereby reducing the load on the combustion-melting zone in the sintering bed.

As a result, first, the productivity is greatly elevated and the quality can be improved and power consumption can be reduced due to reduction in air suction pressure when applied to a sintering machine with the blower driven by costly voltage and an expensive valuable frequency motor.

On the other hand, when an increase in the productivity is not needed, the sintering bed thickness can be consisterably increased by virtue of the improve permeability so that the present invention can attain considerable energy savings by increasing yield by increasing the bed thickness.

Second, sintered cakes of the surface layer of the sintering bed are peeled from the sintering bed and caused to float by magnetic means, and thereby sintering is carried out in the combustion-melting zone of the sintering bed with air preheated through sintered cakes. Thus, the sintering is continued in a load-reduced state, and a thoroughly heat-effective state and good permeability is maintained to advance the reaction efficiently at an accelerated sintering rate without lowering the yield and strength, while enabling production of sintered ores with a good reducibility.

Further, NOx generation can be reduced by virtue of the improved permeability and stabilized combustion of the coke breeze.

In addition, when this invented technology is used, conventional quick lime addition, previously used when it was hard to ensure the production at a desired level due to deterioration in the permeability through the layer of raw materials in the sintering bed, is unnecessary.

As a result of extensive studies based on experiments to solve the problems of the prior art as mentioned above, the present inventors have found that load reduction is an effective means for reducing a load on the combustion-melting zone in the sintering bed without the use of a mechanical means such as stand materials. Accordingly, as a result of further studies based on the foregoing finding, the present inventors have found that load reduction by a magnetic means is most suitable for actual operation. That is, the present inventors conducted detailed tests on the magnetic properties of sintered cakes, and found that magnetism is substantially lost at 600° C. or higher, but a weak magnetism was found to exist below 600° C. in such magnituted as to allow floating by a commercial magnetizing apparatus, as shown in FIG. 1. It was also found that the surface layer region of the sintering bed had a magnetism when quenched even if combustion was under way in the combustion-melting zone of the sintering bed. That is, the present inventors conceived from there findings that the sintering reaction could be carried out while floating the sintered cakes, and thus have established the present invention.

The present invention is also applicable to a method for sintering ores other than iron ores, based on a downward air suction flow, so long as the sintered cakes have a magnetism.

These objects of the present invention can be attained by a method and an apparatus for sintering based on a downward air suction flow, characterized by igniting a layer of raw materials, applying a magnetic field to sintered cakes after sintering starts in the upper level region of the raw materials, and continuing the sintering while applying a magnetic floating force to the already-sintered upper level region.

The magnetic floating force can be applied in two ways. First, it can be applied by applying a magnetic floating force so as to reduce the downward force of the sintered cakes within a range of the downward resultant force due to the gravitation (weight of the sintered cakes) and a suction pressure. Second, it can be applied by applying a magnetic floating force layer as large as the downward resultant force from the gravitation and a suction pressure.

Furthermore, the objects of the present invention can be attained by a method and an apparatus for sintering operation which is characterized by igniting a layer of raw materials to cause progressive sintering, then applying a magnetic field to the sintered cakes when the sintered cakes have a predetermined thickness as the sintering proceeds, applying to the sintered cakes a magnetic floating force larger than a resultant force due to the load of the sintered cakes and a downward force on the sintered cakes due to the suction pressure of a blower, thereby peeling the sintered cakes from the sintering bed situated below the sintered cakes, and then continuing the sintering, while applying a magnetic field to the peeled sintered cakes, thereby maintaining the peeled sintered cakes in a floating state, and thereby continuing the sintering.

BRIEF DESCRIPTION OF THE DRAWINGS

FIG. 10(*b*) is a diagram showing one example of a relationship between the depth of a sintering bed and the load thereof on the combustion-melting zone according to a first mode of the present sintering operation, where the load of sintered cakes is reduced at a constant rate.

FIG. 10(*c*) is a diagram showing another example of a relationship between the depth of a sintering bed and the load thereof on the combustion-melting zone in a second mode of the present sintering operation, where the magnetic floating force is increased according to the increment of the load of the sintered cakes, and a constant load of the sintered cakes is provided in any situation in the lower layer of the sintering bed.

FIG. 10(*d*) is a diagram showing a further example of a relationship between the depth of a sintering bed and the load thereof on the combustion-melting zone according to a fourth mode of the present sintering operation, where a certain amount of the load of sintered cakes is reduced by peeling the sintered cakes and then by maintaining the peeled sintered cakes in a floating state.

FIG. 12(*b*) is a diagram showing another example of a relationship between the depth of a sintering bed and the load thereof on the combustion-melting zone according to a third mode of the present sintering operation, where the load of sintered cakes on the combustion-melting zone in a certain depth of a sintering bed in a pallet is zero.

FIG. 12(*c*) is a diagram showing another example of a relationship between the depth of a sintering bed and the load thereof on the combustion-melting zone according to the second aid of the present sintering operation, where a half amount of the load of sintered cakes, which are produced in a certain depth of a sintering bed in a pallet without any application of a magnetic floating force, is reduced.

DETAILED DESCRIPTION OF THE INVENTION

A method and an apparatus for use in a sintering operation according to the present invention will be explained in detail below.

At first, the zonal structure of a sintering reaction in a sintering machine will be explained. In the sintering bed, a sintering reaction proceeds downward gradually while pallets move in the advancing (or longitudinal) direction of a conveyor. The reaction-completed (or reacted) portion of the raw materials is called "sintered cakes" and is entirely in a state of a rock belt in the sintering machine. Right below the sintered cakes there is combustion-melting zone, where coke is combusted, ores are partially melted by the heat of combustion and powdery ores are joined together by the partial melting to form sintered cakes. At that time, sintered cakes are formed while the combustion-melting zone keeps moving through the raw material from above to form further reacted or sintered portions (sintered cakes).

Below the combustion-melting zone there is a layer of raw materials, whose coke is combusted down to the bottom by the heat transferred from the combustion-melting zone above the layer of raw materials to promote formation of sintered cakes, and the sintering reaction is thus completed when the layer of raw material becomes a layer of sintered cakes.

Figure 1:
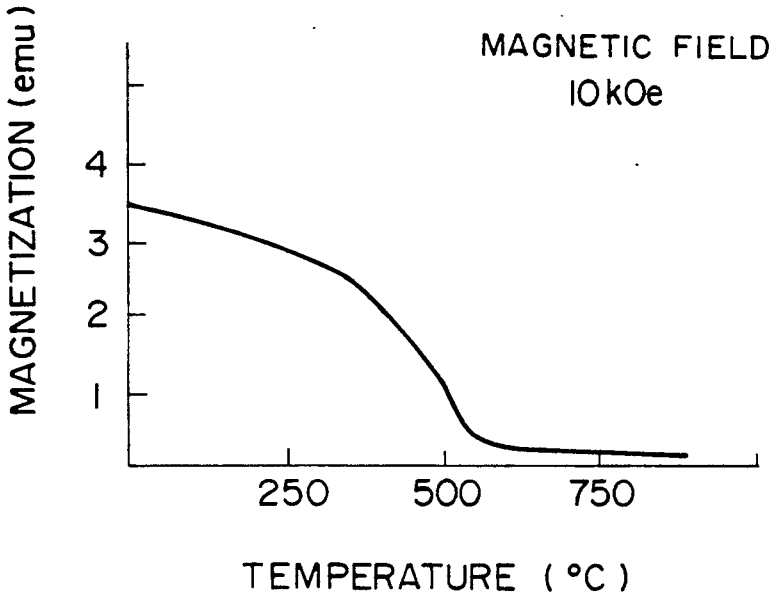
FIG. 1 is a diagram showing a relationship between a magnetization of sintered cakes, when a magnetic field of 10 KoE is applied to the sintered cakes, and a temperature (i.e. dependency of magnetic permeability on temperature).
Figure 2:
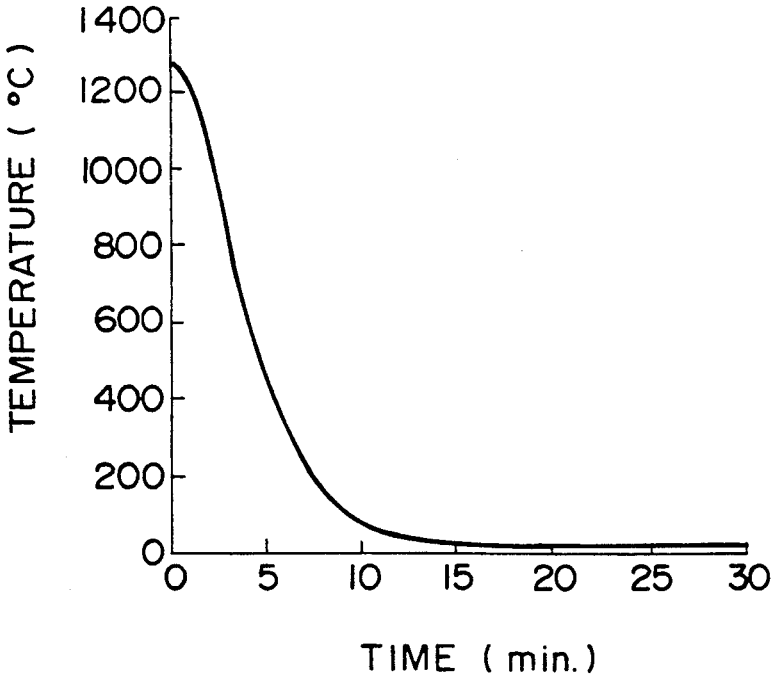
FIG. 2 is a diagram showing a relationship between time and cooling temperature at a level of 100 mm from the surface of a sintering bed (i.e. changes in the surface layer temperature of the sintering bed over time).

Since the sintered cakes are positioned above the combustion-melting layer, a magnetic floating force can be applied to any part at any location thereof, but cooling proceeds continuously from the surface layer of the formed sintered cakes, and, as shown in FIG. 2, the surface layer region is cooled within a short time after the ignition. Thus, a magnetic field is applied to an upper level region of the sintered cakes to develop a floating force in view of the fact that sintered cakes have better magnetic characteristics at lower temperatures, as shown in FIG. 1. Thus, the present invention is not applied to the beginning half of the sintering bed along the conveyor where combustion is still in progress. But this is not a handicap for the present invention, because the magnetic floating is not effective for the portion of the sintering bed at the beginning half of the conveyor due to the initially poor magnetic characteristics thereof.

The magnetic floating force can be applied in two ways. First, it can be applied by applying a magnetic floating force so as to reduce the downward force of the sintered cakes within a range of the downward resultant force due to gravity and the suction pressure. Second, it can be applied by applying a magnetic floating force layer which is greater than the downward resultant force due to gravity and the suction pressure.

In the first way, the sintered cakes are formed as a rock bed without any peeling, whereas in the second way the sintered cakes are peeled from the combustion-melting zone at the moment when a floating force greater than the downward force is applied, so that sintering proceeds in such a manner that two separate pieces of sintered cakes are formed.

The present invention will be explained below with reference to the accompanying drawings.

Figure 3:
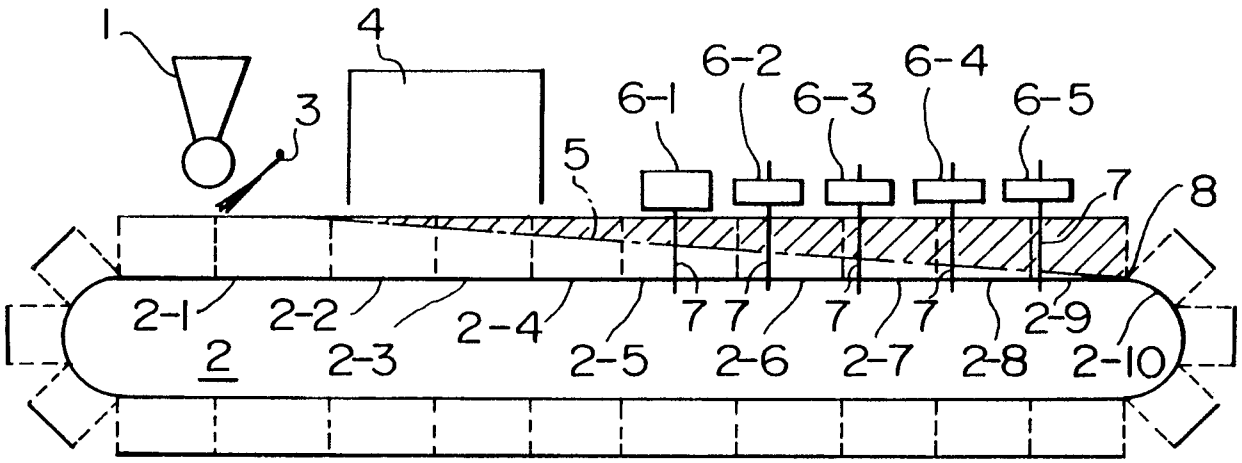
FIG. 3 is a view showing one embodiment of an apparatus for carrying out the present sintering method by using a DL type sintering machine.

FIG. 3 shows one embodiment of an apparatus for carrying out the present sintering process by using a DL type sintering machine.

Raw sintering materials stored in a surge hopper 1 are charged onto pallets of a sintering machine 2 through a raw material charger 3 to form raw material layers on the pallets. The raw material layers are then ignited by an ignition furnace 4. Sintering proceeds while the combustion-melting zone gradually migrates downwardly from the surface region toward the lower level region. After passage through the ignition furnace 4, sintering occurs progressively from the upper level region of the sintering bed to form solidified and cooled sintered cakes.

As shown in FIG. 3, the gradual downward migration of the combustion-melting zone (sintering reaction zone) through the layer of sintering materials on pallets 2-2 to 2-9 is shown by an alternate long and short dash line 5. In the region above the line 5, that is, the sintered zone, there are the sintered cakes for which the sintering reaction has been completed, whereas in the region below the line 5, the raw materials remain to be sintered. Reference numeral 8 represents a point of completion of the sintering process and a point at which the sintered cakes are discharged at the location of pallet 2-10.

When the temperature of the sintered cakes is brought to 600° C. or lower, preferably within a range of room temperature up to 500° C. and more preferably within a range of room temperature up to 345° C., at a depth of 50 to 150 mm from the surface of sintered cakes, a magnetic field is applied from magnetic floating apparatuses 6-1 to 6-5, provided above the pallets 2-5 to 2-9 by mounting supports 7 while the electric current is controlled through magnetic coils and gap sizes between the magnetic pole end and the surface of the sintering material is controlled predetermined ranges, respectively, thereby adjusting the magnetic floating force.

Thus, by making a magnetic floating force act on the sintered cakes, the load on the combustion-melting zone and on the layer of raw materials below the combustion-melting zone 5 can be made zero or reduced. By making the loading on the layer of raw materials zero or reducing the load, the air permeability through the combustion-melting zone can be improved, resulting in stabilization of the combustion of coke breeze in the raw materials and acceleratation of combustion speed.

The modes of applying a magnetic force in the present invention will be explained below.

According to the first mode of the present invention, as shown in FIG. 10(*b*), sintering is carried out while applying a magnetic floating force to the upper level region of the sintered cakes, (i.e. the combustion-completed portion). The magnetic floating force is of a given magnitude within a range not exceeding the resultant force of the gravitation (i.e. weight) of the sintered cakes and a downward force on the sintered cakes due to a suction pressure of a blower. The magnetic force is applied at and beyond a location where the sintered cakes have a given thickness as the sintering progresses after the ignition of the layer of raw materials. Conventionally, the force was larger at a lower level. Thus, in the present invention, the downward force is reduced by a given magnitude relative to that in the conventional method where there is no application of a magnetic force.

Even if the magnitude of the magnetic floating force is small, if it is applied, it is effective. In this case, as compared with the conventional method, the productivity and yield can be improved, and qualities (reducibility and particle size distribution) can be improved to some extend.

Figure 12A:
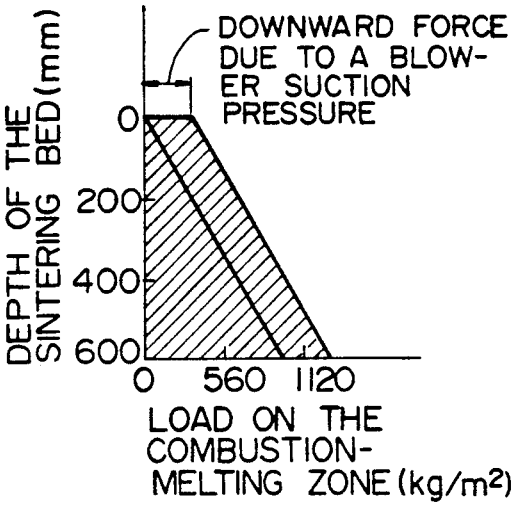
FIG. 12(*a*) is a diagram showing one example of a relationship between the depth of a sintering bed and the load thereof on the combustion-melting zone as a resultant force from the load of sintered cakes and the suction pressure of a blower.
Figure 12B:
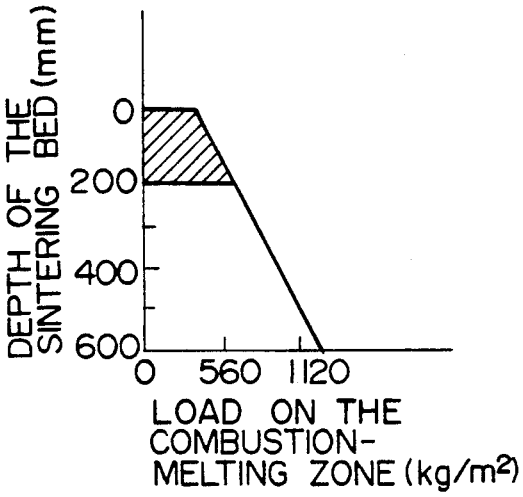
Figure 12C:
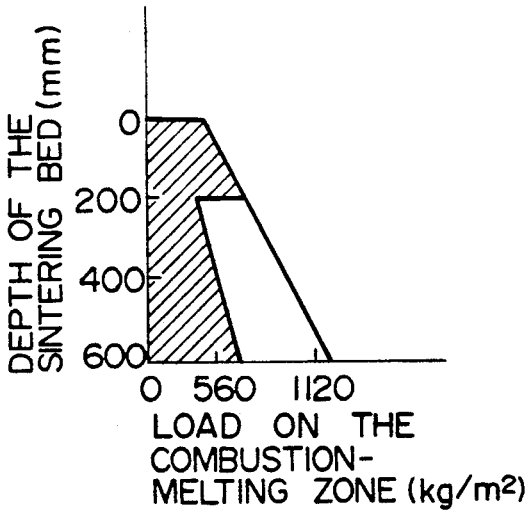
Figure 13A:
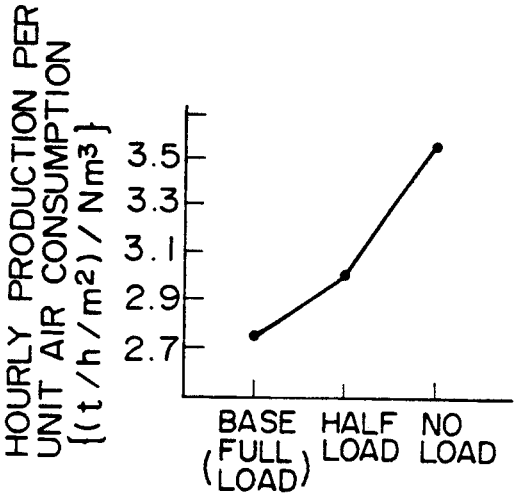
FIGS. 13(*a*) to 13(*b*) are diagrams ow sintering results obtained according to FIGS. 12(*a*) to 12(*c*), where "base (full load)", "half load" and "no load" show sintering processes conducted according to FIG. 12(*a*), FIG. 12(*c*) and 12(*b*), respectively.
Figure 13B:
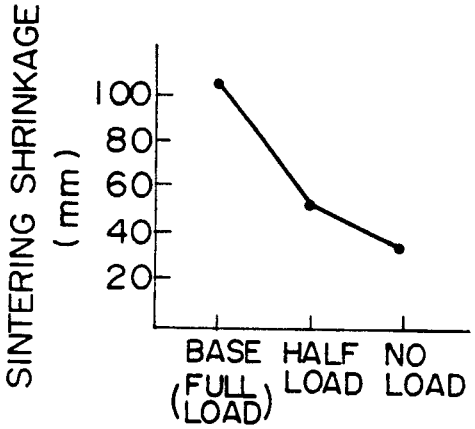
Figure 13C:
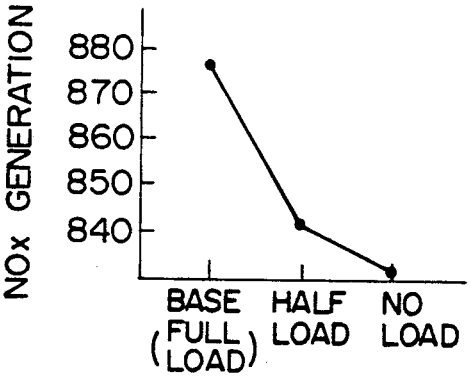
Figure 13D:
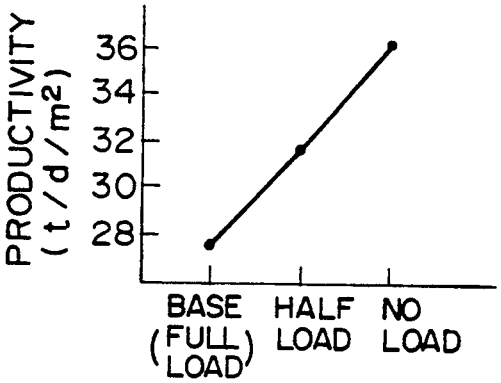
Figure 13E:
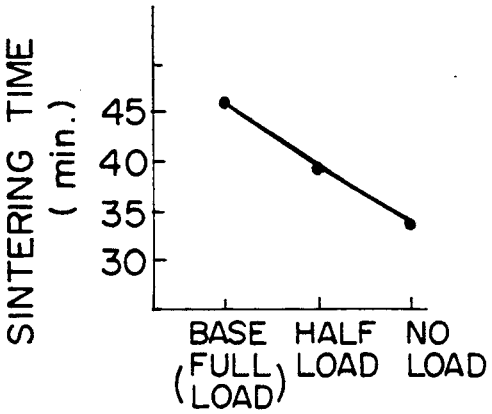
Figure 13F:
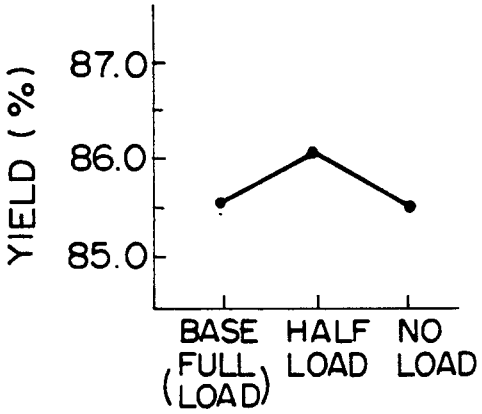
Figure 13G:
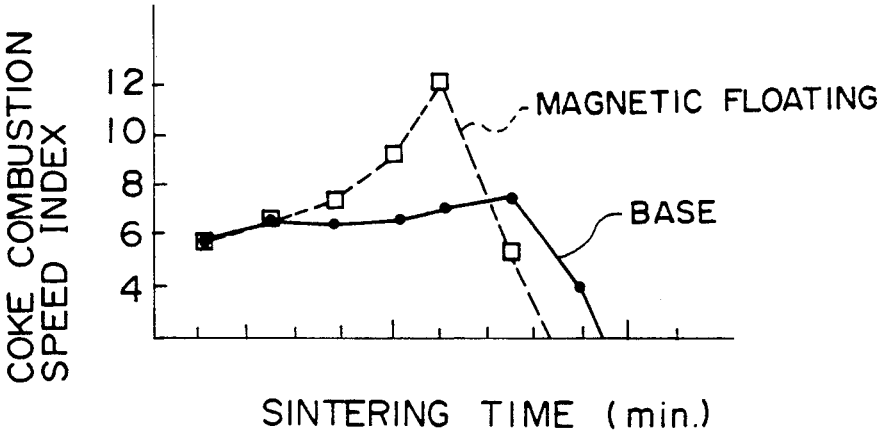
Figure 13H:
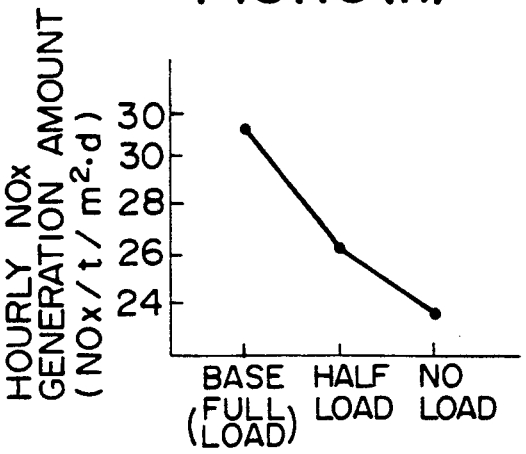
Figure 14A:
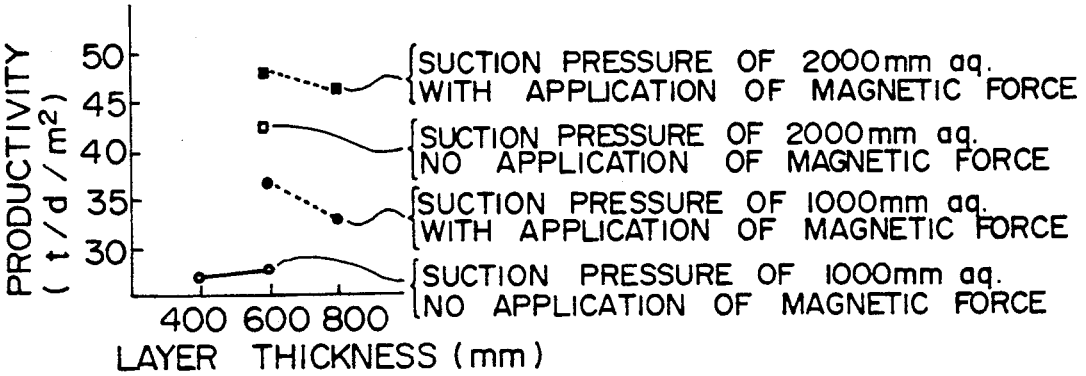
FIGS. 14(*a*) to 14(*e*) are diagrams showing sintering results obtained by changing the thickness of the sintering bed and the suction pressure by a blower as shown in Table 3, where ○ shows a case where the suction pressure is 1,000 mm ap. without any application of a magnetic force, shows a case where the suction pressure is 1,000 mm ap. with application of a magnetic force, □ shows a case where the suction pressure is 2,000 mm aq. without any application of a magnetic force, and shows a case where the suction pressure is 2,000 mm aq. with application of a magnetic force. Moreover, the magnetic force was applied in such a strength that the load on the combustion-melting zone is zero.
Figure 14B:
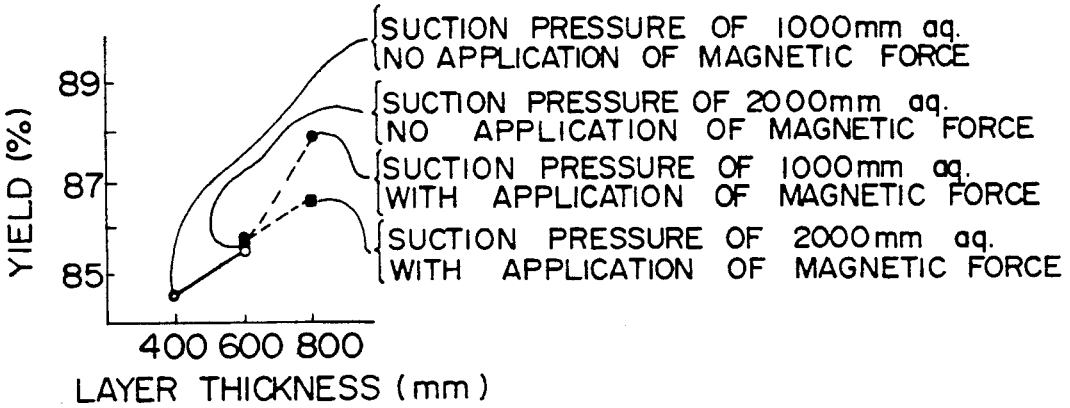
Figure 14C:
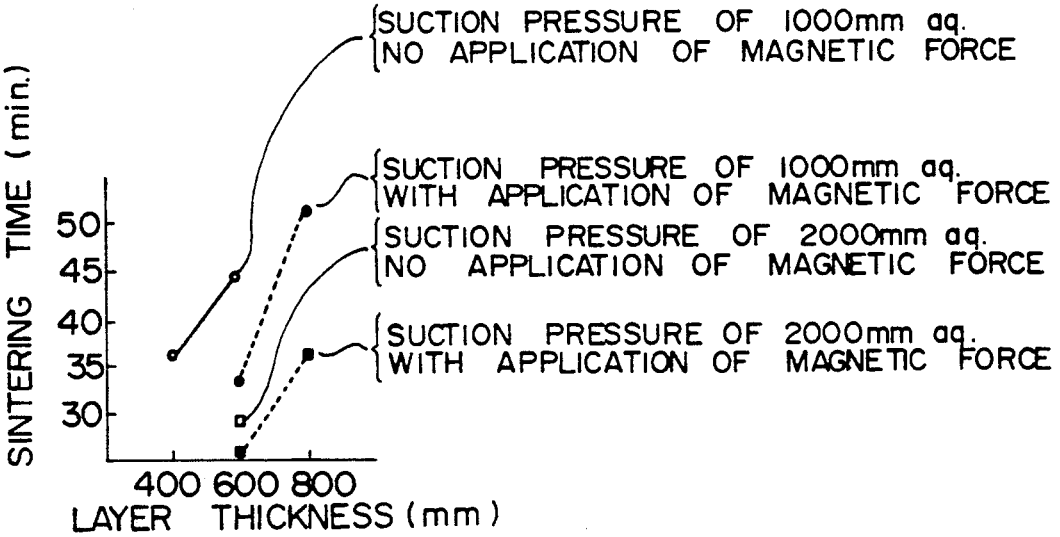
Figure 14D:
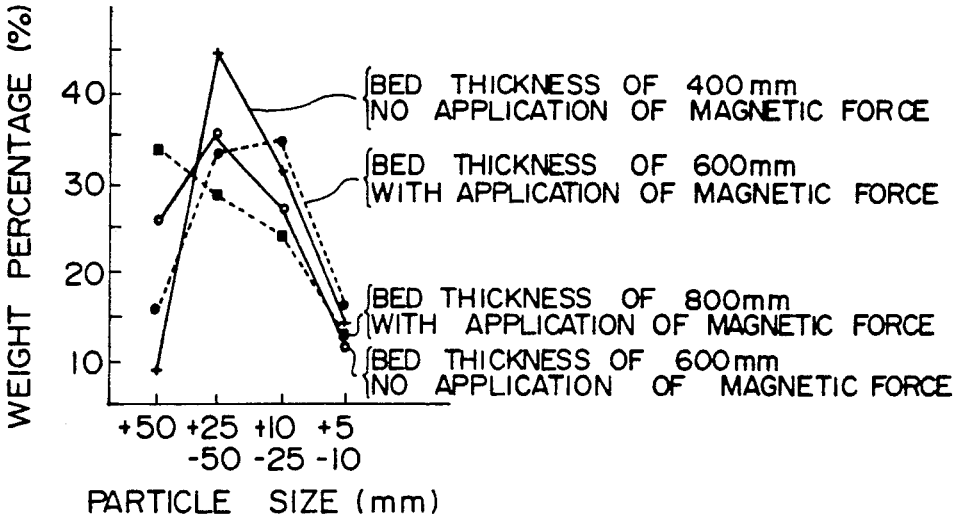
Figure 14E:
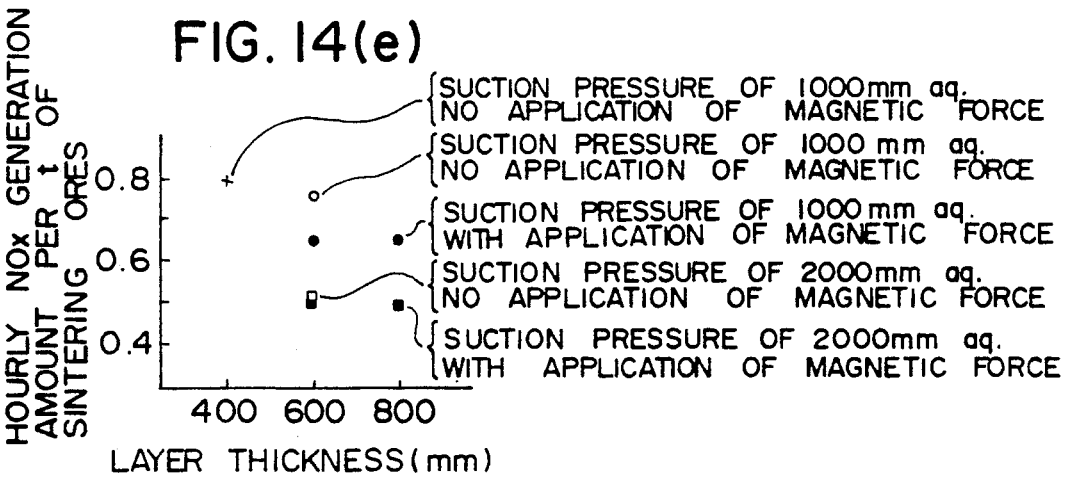

According to the second mode of the present invention, as shown in FIG. 10(*c*) or FIG. 12(*c*), a magnetic filed is applied to the sintered cakes formed by sintering when the sintered cakes come to have a given thickness due to the progress of the sintering after the ignition of the layer of raw material. As the sintering progresses, a magnetic force is applied to the sintered cakes in an increasing manner corresponding to an increasing load of the sintered cakes due to the increasing thickness of the sintered cakes due to the degree to which the sintering has progressed. The magnetic floating force must be increased as the combustion-melting zone progresses downwardly, to thereby maintain the downward force on the combustion-melting zone at a constant level. In this case, as compared with the conventional method, the productivity and yield can be improved and the quality (reducibility ad particles size distribution can also be considerably improved.

According to the third mode of the present invention, as shown in FIG. 12(*b*), a magnetic force equal to the resultant force from the weight of the formed sintered cakes and a downward force on the sintered cakes due to the suction pressure of a blower is applied to the sintered cakes. This magnetic force is applied at and beyond a location where the sintered cakes have a given thickness due to the progress of the sintering after ignition of the layer of raw materials, and thus the sintering is continued in the resulting load-free state. That is, the sintered cakes are maintained under a magnetic floating force equal to the downward force on the combustion-melting zone. Since the combustion-melting zone expands or shrinks to some extend between the sintered cakes and the layer of raw materials below the sintered cakes, a magnetic floating force substantially equal to the resulting force may be applied. In this case, as compared with the conventional method, the productivity and yield can be improved, and the quality (reducibility and particle size distribution) can be remarkably improved.

In the foregoing first to third modes of the present invention, sintering is carried out while maintaining a gap between the magnetic pole end and the surface of the sintering bed, for example, in a range of 10 to 50 mm, dependent on the composition of the sintering raw materials, and the smoothness of the sintering bed surface, etc. Furthermore, a magnetic floating force is made to act on the sintered cakes by controlling an electric current through electromagnetic coils, for example, to apply a magnetic field of not less than 0.3 T(Tesra) to the sintered cakes.

According to the fourth mode of the present invention, a magnetic force larger than the resultant force from the weight of the formed sintered cakes and a downward force on the sintered cakes due to the suction pressure of a blower is applied to the sintered cakes. The magnetic force is applied at and beyond a location at which the sintered cakes have a given thickness due to the progress of the sintering after ignition of the layer of raw materials. Thus, due to the large magnetic force, the sintered cakes are peeled from the sintering bed below the sintered cakes. Sintering is continued while continuously applying a magnetic force to the peeled sintered cakes to maintain the sintered cakes in a floating state with a constant gap range between the magnetic pole end and the surface of the sintered cakes or with zero gap therebetween with the sintered cakes being attracted to the magnetic pole end. In this case, a floating force larger than the downward force on the combustion-melting zone is applied and then the sintered cakes are maintained in a floating state. Thus as compared with the conventional method, the productivity and yield can be improved, and the quality (reducibility and particle size distribution) can be considerably improved.

In the foregoing fourth mode, the sintered cakes are made to peel away from the sintering bed below the sintered cakes, for example, when the temperature of the sintered cakes is brought into a range of room temperature to 500° C., preferably room temperature to 413° C. at a depth of 50 to 150 mm from the surface of the sintered cakes, and/or when the sintered cakes come to have a thickness ranging from 200 to 400 mm. After the peeling of the sintered cakes from the sintering bed below the sintered cakes, a magnetic field is applied to the sintered cakes by controlling an electric current through electromagnetic coils, thereby creating a magnetic floating force which acts on the sintered cakes while the sintering continues with the peeled sintered cakes maintain in a floating state and while a gap is maintained between the magnetic pole end and the surface of the sintering bed within, for example, a range of 10 to 50 mm. Or, a magnetic field is applied to the sintered cakes by controlling an electric current through electro-magnetic coils, to thereby create a magnetic floating force which acts on the sintered cakes to attract them toward the magnetic pole end while sintering continues and while zero gap is maintained between the magnetic pole end and the surface of the sintering bed with the peeled sintered cakes in a floating state.

In the conventional method, permeability is not good at the lower level regions of the combustion-melting zone, resulting in excess melting and pores being clogged easily. Thus results in uneven sintering (due to uneven combustion of the cakes). This leads to a lower yield and fluctuation in the quality. However, in the present invention, good permeability can be maintained throughout the sintering bed and even in the combustion-melting zone, and thus coke breeze can be combusted in a thermally efficient state. That is, efficient reaction can proceed at a higher sintering speed. Thus, the yield can be improved and the quality of the sintered ores can be stabilized at a higher level. At the same time the problem of low reducibility due to pore clogging can also be improved.

Figure 4:
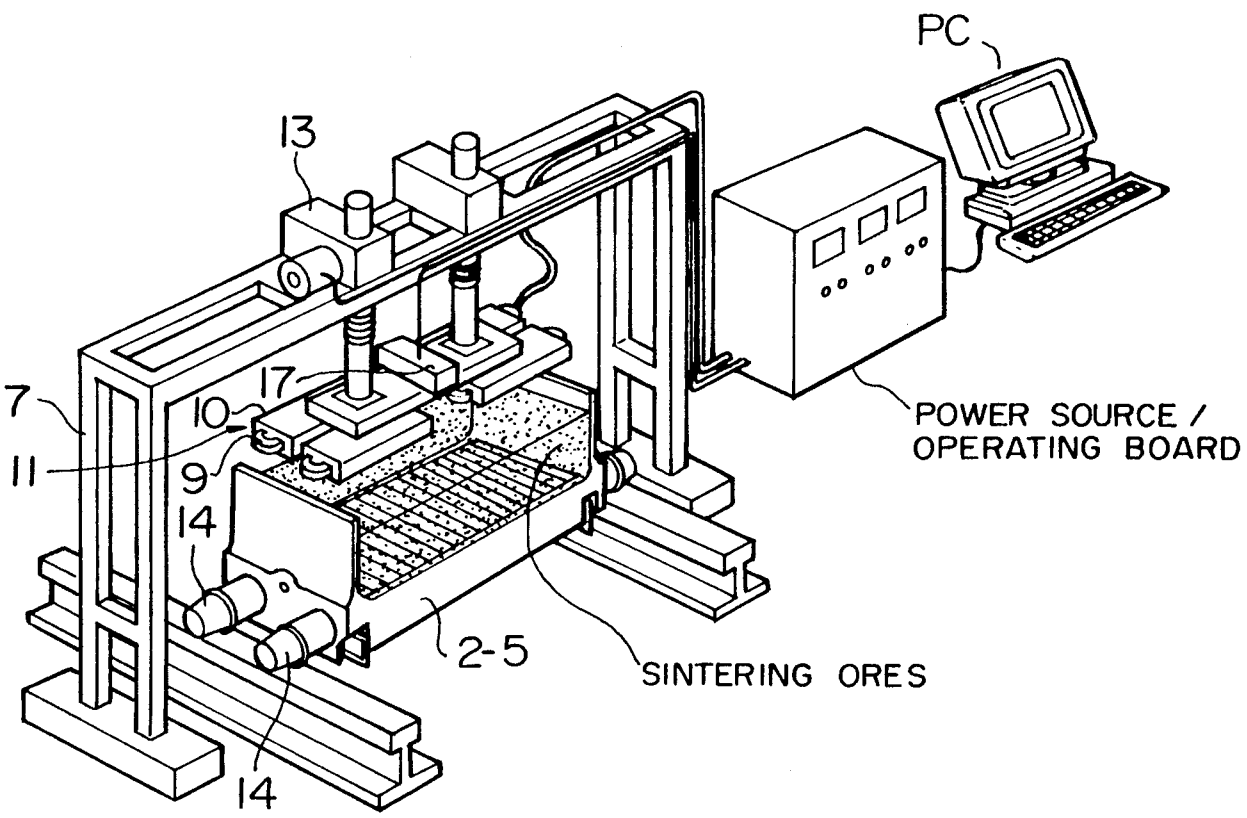
FIG. 4 is a schematic perspective view of a magnetic floating apparatus according to the present invention, where magnets are provided over a pallet.

FIG. 4 shows one embodiment of the structure of a magnetic floating apparatus 6-1 according to the present invention, which comprises magnets 11 each comprising a magnetic coil 9 and an iron core frame 10 provided above a pallet 2-5 and supported by a mounting frame 7, a laser-type or ultrasonic type gap sensor 17 for measuring a gap size between a magnetic pole end and the surface of the sintering bed formed in the pallet 2-5, and a manually operable and electrically movable level controller 13 capable of adjusting the gap size. With this arrangement, a magnetic floating force can be adjusted by controlling the electric current through the magnetic coil 9 and the mounting position relative to the pallet 2-5, particularly the gap between the magnetic pole end and the surface of sintered cakes.

In the forgoing first and third modes, power of the magnetic floating apparatus 6-1 is such that the magnetic floating force is equal to or less than the resultant force from the weight of the formed sintered cakes and a downward force on the sintered cakes due to suction pressure of a blower.

Power for the magnetic floating apparatus 6-1 for causing peeling of sintered cakes from the sintering bed is such that the magnetic force is larger than that for other magnetic floating apparatuses 6-2 to 6-5. After the peeling of the sintered cakes, the magnetic floating force is satisfactory only for maintaining the sintered cakes in a floating state, and thus power for magnetic floating apparatuses 6-2 to 6-5 other than 6-1 can be smaller than that for peeling the sintered cakes. Numeral 14 represents rollers for moving the pallet 2-4. Generally, an electromagnetic is used in the present invention as the magnet comprising an electromagnet and a permanent magnet partially integrated in the electromagnet can also be used in the present invention. Furthermore, a superconducting magnet can be used to attain a lower cost, a smaller size and a lighter weight. A permanent magnet can be also used, if it has a high magnetism.

In some case, a water cooling system is sued for the coil.

Figure 5:
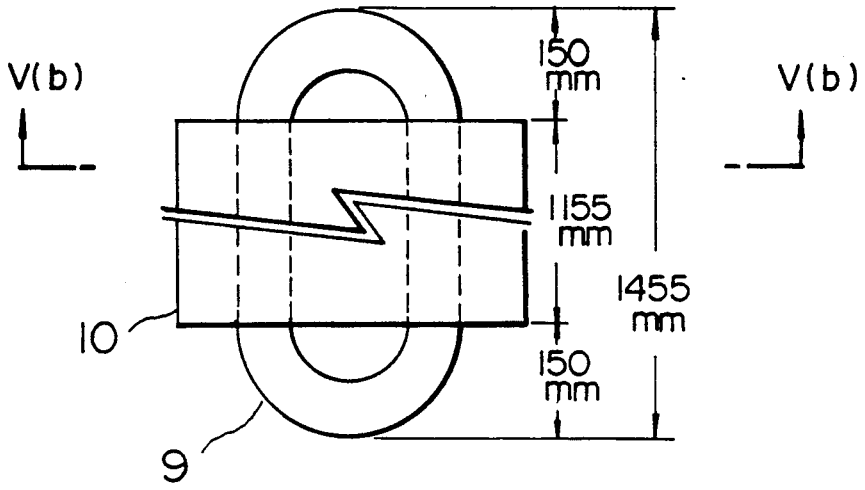
FIG. 5(*a*) is an enlarged schematic plan view showing one embodiment of the structure of the magnet according to the present invention shown in FIG. 4, and FIG. 5(*b*) is a cross-sectional view along the line V(*b*)—V(*b*) of FIG. 5(*a*).
Figure 5:
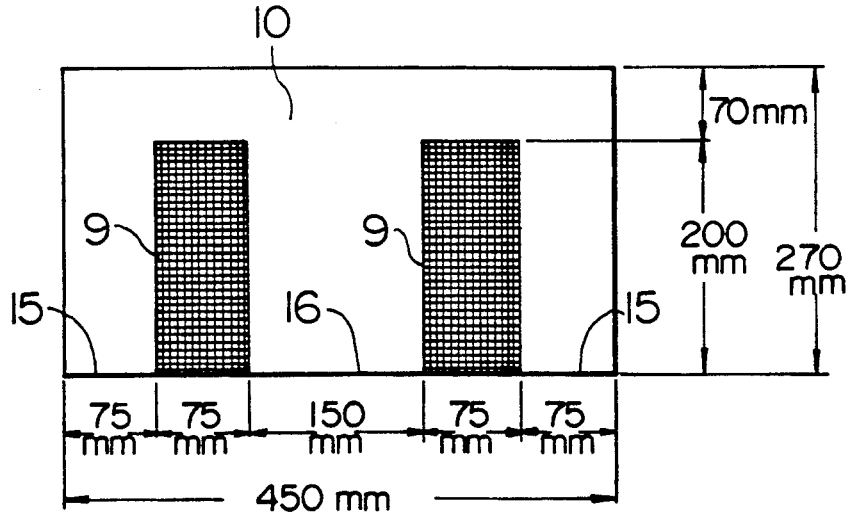

FIG. 5(*a*) is an enlarged schematic plan view of the magnet 11 comprising the magnetic coil 9 and the iron core frame 10 shown in FIG. 4, and FIG. 5(*b*) is a cross-sectional view along the line V(*b*)—V(*b*) of FIG. 5(*a*). When the lower ends 15 at both sides of the iron core frame 10 are S poles, the lower end 16 at the center of the iron core frame 10 will be an N pole, and a magnetic field is applied to the sintered cakes from the S poles and N pole to create a magnetic floating force to act on the sintered cakes.

In the foregoing first to fourth modes, a magnetic field can be applied to both sides and/or the upper side of the sintered cakes.

Figure 6:
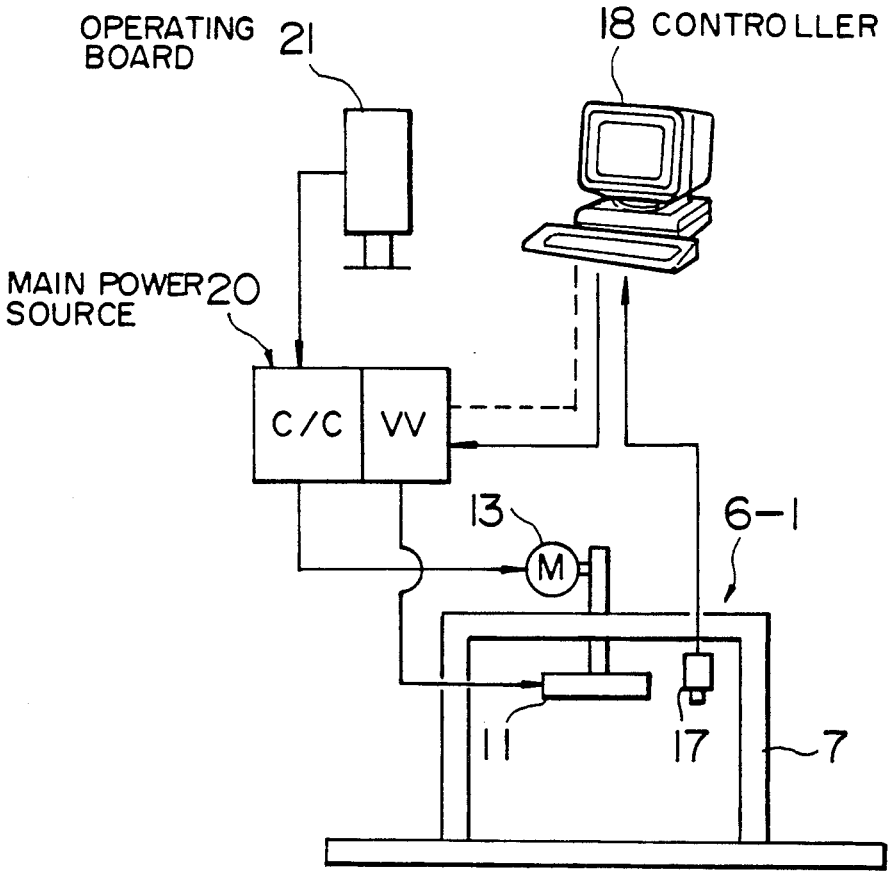
FIG. 6 is a view showing one embodiment of the structure of an entire electrical system of an apparatus for carrying out the present sintering operation.

FIG. 6 is a view showing one embodiment of an electrical structure for the entire system according to the present invention including at least one sintering apparatus. The sintering apparatus comprises a magnetic floating apparatus 6-1 comprising at least one magnet 11 provided above a pallet of a sintering machine by a mounting frame 7 and arranged to direct a magnetic pole end toward the pallet, a magnetic level control 13 for controlling a gap size between the magnetic pole end and the surface of the sintering bed formed by the pallet, and a gap sensor 17 for measuring a gap size. The magnetic floating apparatus 6-1 and the gap sensor 17 are provided in the longitudinal direction of the sintering machine in a magnetizing region extending from the outlet of an ignition furnace to the inlet of a sintered ore discharge section. A necessary magnetic floating force for the position of at least one magnet 11 in the longitudinal direction of the sintering machine is input to a controller 18 as data to enable selection of individual magnetization patterns. The controller 18 computes an electric current from a set electromagnetic force and the gap to control an electric current to the magnet 11 through a main power source 20, thereby controlling the set electromagnetic force and also the gap size by the magnetic level controller 13, so as to control the magnetic floating force. When required, the magnet level controller 13 can be manually operated through an operating board 21 to control the gap size.

Control of the magnetic floating force by the controller 18 is to control the electric current at a constant gap size in principle. In the case of a pattern with a small electromagnetic force, the floating force is decreased with increasing gap size due to the sintering shrinkage. Thus, there is a fear of failing to apply a necessary floating force for the magnetization of the lower level region. To overcome such a feat, the gap size must be maintained constant, for example, in a range of 10 to 50 mm, preferably 20 to 30 mm, by manual level control of the magnet.

An electromagnet and/or a permanent magnet is used as the magnet 11 to apply a magnetic field to the sintered cakes. Only the electromagnetic coil may be used, but electric power can be saved by combined use of the permanent magnet.

Figure 7:
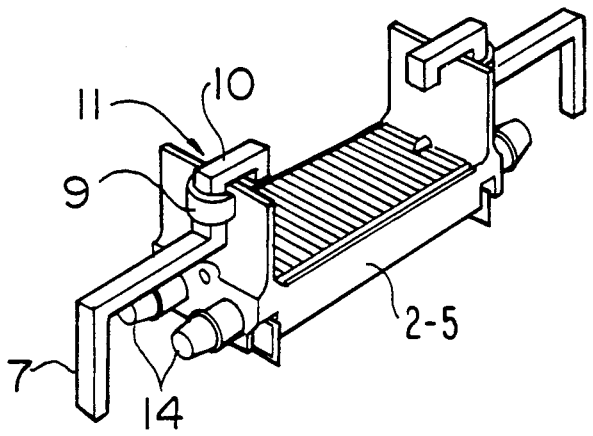
FIG. 7 is a schematic perspective view showing a second embodiment of a magnetic floating apparatus according to the present invention, where magnets are provided above and beside a pallet.

FIG. 7 shows another embodiment of the structure of a magnetic floating apparatus according to the present invention, which can be employed in practicing the foregoing first to fourth modes of the present invention. In this embodiment, a magnet 1 comprises a magnetic coil 9 and an iron core frame 10 and is provided above a pallet 2-5 of a sintering machine by a mounting frame 7.

Figure 8:
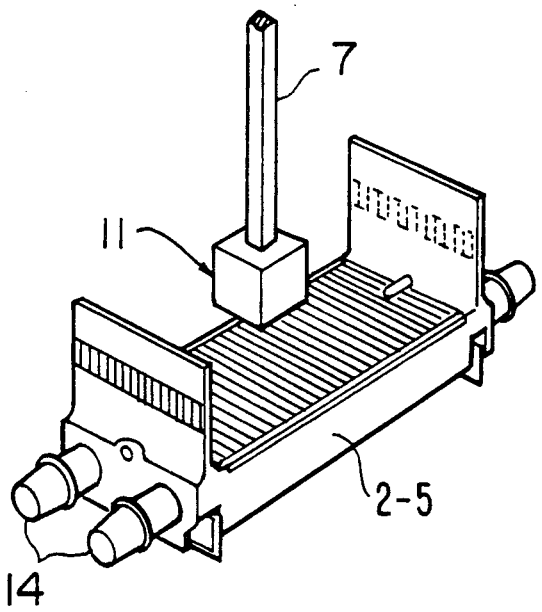
FIG. 8 is a schematic perspective view showing a third embodiment of a magnetic floating apparatus according to the present invention, where a permanent magnet is provided above a pallet.

In the foregoing first and second modes of the present invention, a permanent magnet 11 can be provided above a pallet 2-5 of a sintering machine by a mounting frame 7, as shown in FIG. 8, to form a magnetic floating apparatus 6. Substantially the same effects as above can be obtained with this arrangement.

Figure 9:
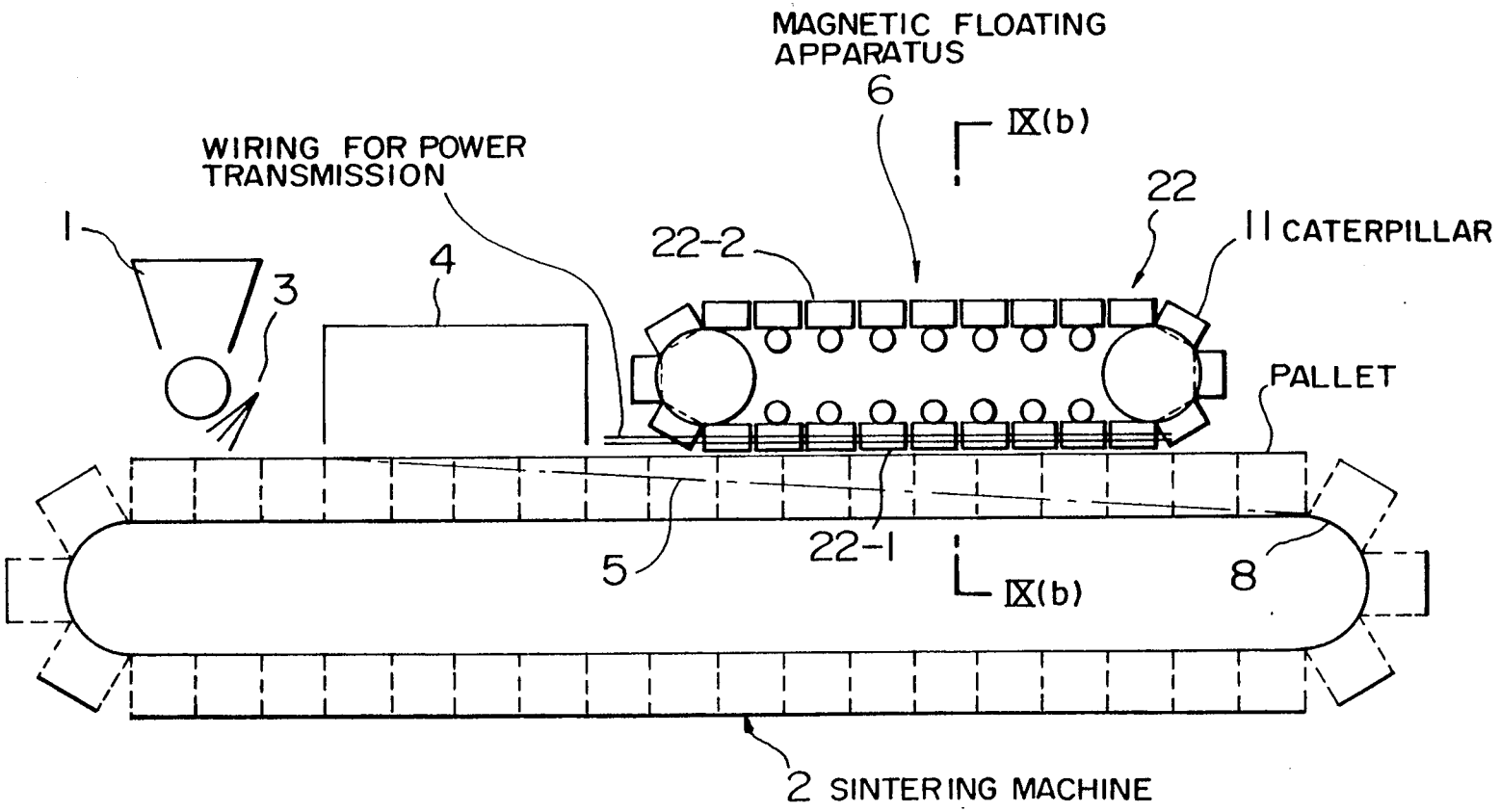
FIG. 9(*a*) is a schematic perspective view showing a fourth embodiment of a magnetic floating apparatus according to the present invention, where a set of caterpillar magnets are provided above pallets, and FIG. 9(*b*) is a cross-sectional view along the line IX(*b*)—IX(*b*) of FIG. 9(*a*).
Figure 9B:
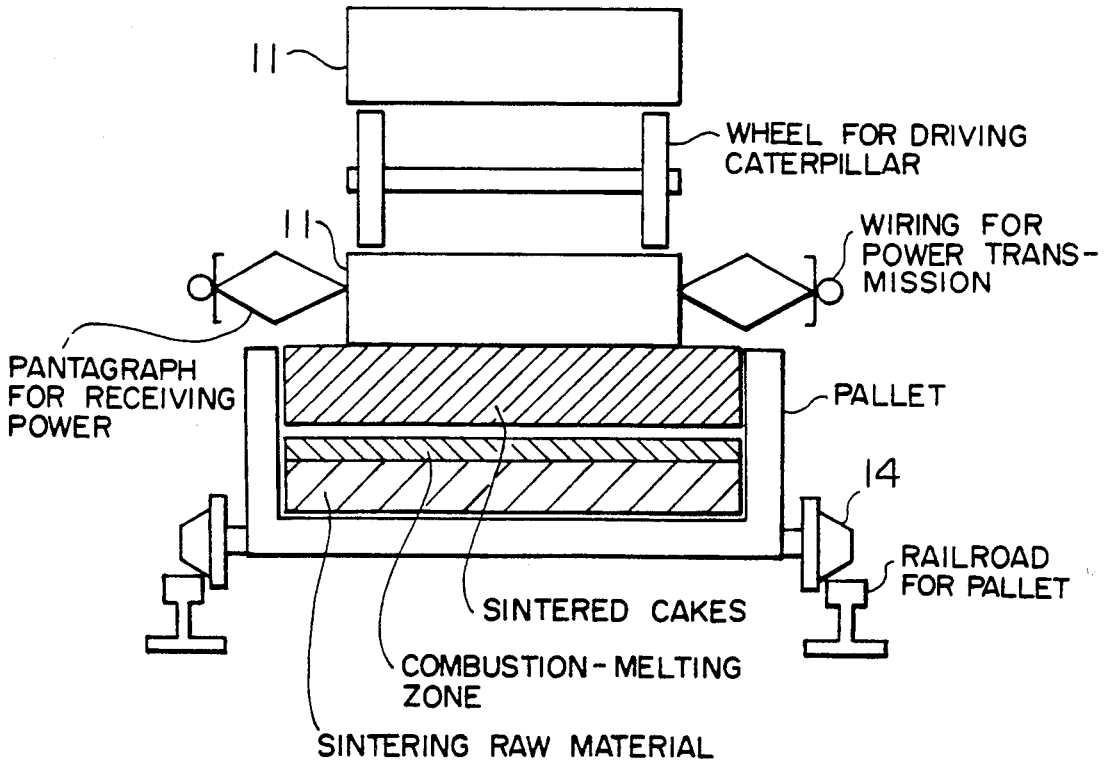
Figure 10A:
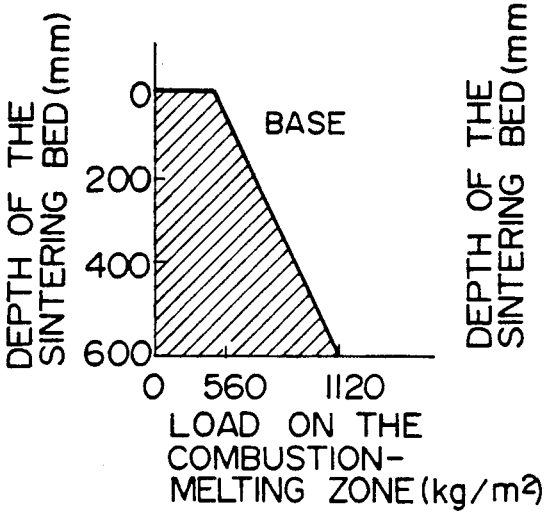
FIG. 10(*a*) is a diagram showing one example of a relationship between the depth of a sintering bed (thickness of sintered cakes formed as the sintering progresses) and the load thereof on the combustion-melting zone in a conventional sintering process without any step for reducing the load of sintered cakes.
Figure 10B:
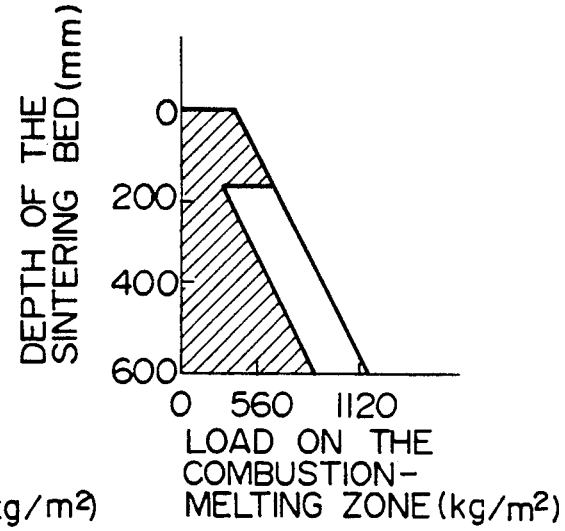
Figure 10C:
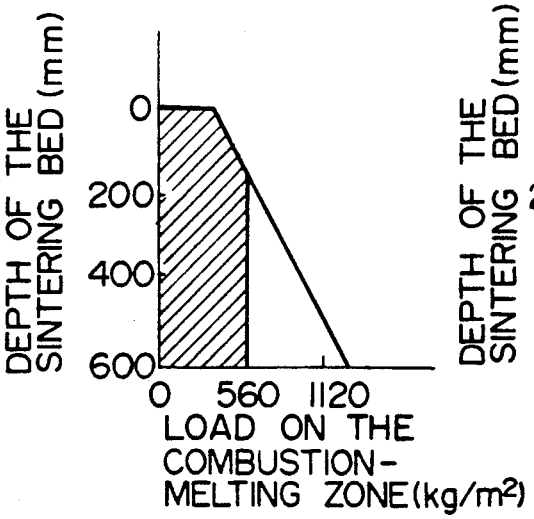
Figure 10D:
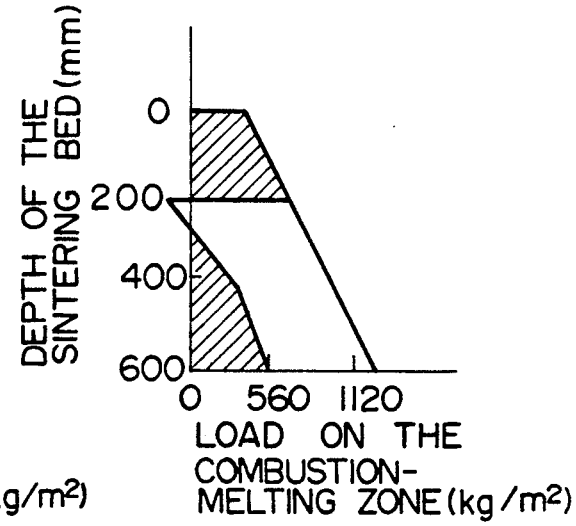
Figure 11A:
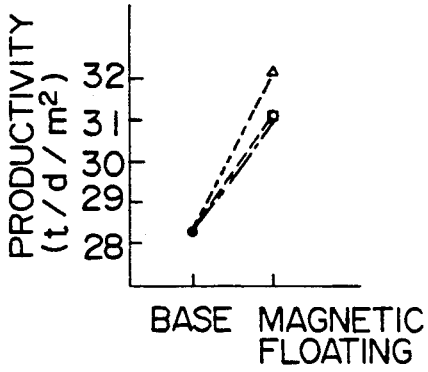
FIGS. 11(*a*) to 11(*e*) are diagrams showing sintering results obtained by sintering according to FIGS. 10(*a*) to 10(*d*), where marks , □, Δ, and ○ show sintering processes based on FIGS. 10(*a*), 10(*b*), 10(*c*) and 10(*d*), respectively.
Figure 11B:
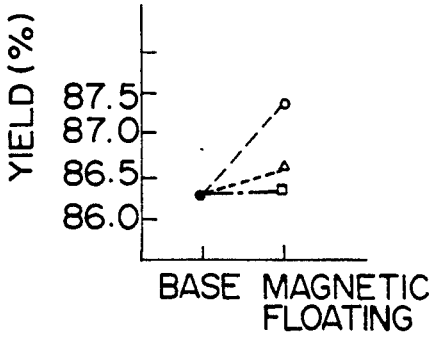
Figure 11C:
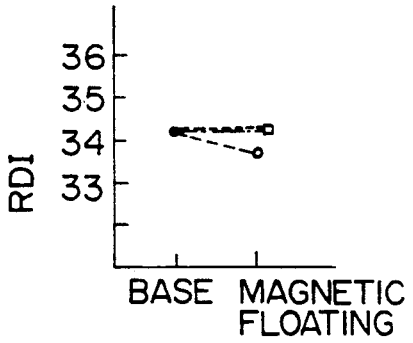
Figure 11D:
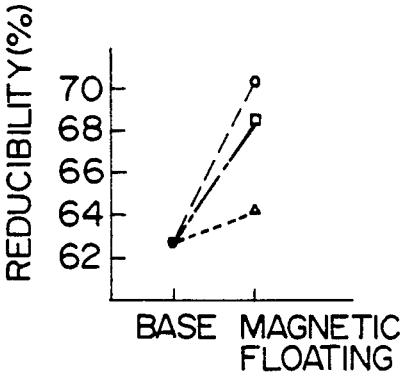
Figure 11E:
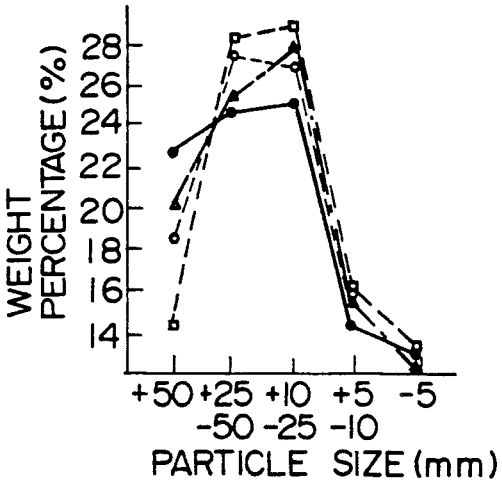

FIGS. 9(*a*) and 9(*b*) show another embodiment of a magnetic floating type apparatus for use in a sintering operation according to the present invention, which can be used to practice the foregoing fourth mode of the present invention. In this embodiment, a magnetic floating type apparatus for use in a sintering operation comprises a rotatable caterpillar belt comprising a plurality of magnets 11, each having magnet pole ends, provided above a set of pallets of a sintering machine. The caterpillar belt of magnets 11 is provided along the longitudinal direction of the sintering machine in a magnetizing region extending from the outlet of an ignition furnace to the inlet of a sintered ore discharge section.

A method for controlling the magnetic floating apparatus 6 shown in FIGS. 9(*a*) and 9(*b*) will be explained with reference to FIG. 6. That is, a magnetic floating apparatus 6 shown in FIGS. 9(*a*) and 9(*b*) is used, and a necessary magnetic floating force for the position of at least one magnet 11 in the longitudinal direction of the sintering machine is input to a controller 18 as data to enable selection of individual magnetization patterns. The controller 18 computes an electric current from a set electromagnetic force to control an electric current to the magnet 11 through a main power source 20, thereby controlling the magnetic floating force.

When the magnets 11 constituting the rotatable caterpillar belt are transferred along the lower run 22-1 of the caterpillar belt in opposition to the set of pallets by rotation, an electric current is passed through the electromagnetic coils of the magnets 11 to develop a magnetic field in the magnets, thereby peeling the sintered cakes off the sintering bed disposed below the sintered cakes. Then, the magnets 11 proceed while holding the peeled sintered cakes attracted to the magnetic pole ends. When the magnetic 11 reach the sintered ore discharge section, that is, the sintered cake discharge section, and when the magnets 11 which have thus for travelled along the lower run 22-1 of the caterpillar belt are moved to the upper run 22-2 of the caterpillar belt by rotation, the passage of the electric current to the electromagnetic coils of the magnets 11 is discontinued, thereby causing the magnets to proceeding along the upper run 22-2 without any application of a magnetic field. In this manner, the magnetic floating force is controlled.

PREFERRED EMBODIMENTS OF THE INVENTION

Examples of the present invention will be explained in detail below, referring to the accompanying drawings.

Raw materials having the following composition were used in the following Examples: T.Fe: 52.45%, CaO: 7.35%, $SiO_2$: 5.27%, $Al_2O_3$: 2.33%, MgO: 1.04% and C: 2.89%.

EXAMPLE 1

A magnetic floating type apparatus for use in a sintering operation, shown in FIGS. 3 to 6, was used. Sets of 4 magnets (electromagnets) 11 having a floating capacity of 750 kg/magnet at a gap size of 30 mm, each magnet comprising a magnetic coil 9 and an iron core frame 10, were provided above pallets (2-1, etc.) of a sintering machine, respectively, by mounting frames 7, as shown in FIG. 3. Electric power consumption/electromagnet was 70 kW with a coil turning of 250, an electric current of 350 A and a voltage of 200 V. The magnetizing region extending from the outlet of an ignition furnace 4 to the inlet 8 of the sintered ore discharge section was 35 m long and the gap sensor 17 was of the ultrasonic type. A manually operable, electrically movable magnet level controller was used as controller 13. A necessary magnetic floating force for the position of at least one magnet 11 in the longitudinal direction of the sintering machine was input to the controller 18 to enable selection of the following magnetization pattern. The controller 18 computed an electric current from a set electromagnetic force and the gap to control an electric current to the magnet 11 through the main power source 20, thereby controlling the set electromagnetic force and also controlling the gap size by the magnetic level controller 13, so as to control the magnetic floating force.

During the sintering operation with a DL sintering machine having a sintering area of 180 $m^2$ (3 m wide×60 m in strand length) and a sintering bed thickness of 600 mm at a suction pressure of 1,600 mm aq. created by a blower, magnetic floating apparatuses 6-1, 6-5, as shown in FIG. 4, where provided at a distance of 1 m in a region extending from a point of about 15 m from the ignition furnace 4 (temperature at a level of 240 mm from the surface of the sintered cakes: 600° C.; thickness of the sintered cakes: 240 mm) to a burn-through-point (BTP: point of sintering combustion completion) of about 50 m from the ignition furnace 4, as shown in FIG. 3.

As shown in FIG. 10(*b*), sintering was carried out while reducing the load of the sintered cakes on the combustion-melting zone 5. An electric current of 120 A was passed to the individual magnetic floating apparatuses while controlling the gap between the magnetic pole ends and the surface of the sintered cakes to 30 mm, and a magnetic floating force corresponding to one half of a total 700 kg/$m^2$) of the suction pressure on the combustion-melting zone 5 by a blower and the load of the formed sintered cakes is applied to the sintered cakes formed as the sintering progressed in the region extending from a point about 15 m from the outlet of the ignition furnace 4 to the BTP to reduce the load of the sintered cakes on the combustion-melting zone 5. Sintering was carried out in this manner.

Usually the thickness of the sintering bed from the ignition furnace 4 is decreased by shrinkage as the sintering progressed and the sintering bed is shrunk by about 100 mm at a point near the sintered ore discharge section, whereas the shrinkage of this example 1 was about 45 mm.

As a result, as shown in FIGS. 11(*a*) to 11(*d*), where a case in which no magnetic force was applied is plotted by , and a case in which magnetic force was applied is plotted by Δ, the productivity was 28.4 t/d/$m^2$ in the case in which no magnetic force was applied, whereas in the case in which magnetic force was applied, the productivity was increased to 32.2 t/d/$m^2$. Thus, the productivity was improved by 13%. The yield of 86.25% was changed to 86.5%. Usually, an increase in the productivity lowers the yield, and thus the yield was substantially improved by about 2%. RDI was not changed. However, the percent reducibility was improved from 62.4% to 64.0%.

EXAMPLE 2

The same magnetic floating type apparatus for use in a sintering operation was used in this example as was used in Example 1. During the sintering operation in the same DL sintering machine with a sintering bed thickness of 600 mm at a suction pressure of 1,600 mm aq. created by the blower in the same manner as in Example 1, magnetic floating apparatus 6-1 to 6-5 as shown in FIG. 4 were provided at a distance of 1 m in a region extending from a point about 15 m from the ignition furnace 4 (temperature at a level of 240 mm from the surface of the sintered cakes: 600° C., thickness of the sintered cakes: 200 mm) to the BTP, about 50 m from the ignition furnace 4, as shown in FIG. 3.

As shown in FIG. 10(*c*), sintering was carried out while reducing the load of sintered cakes on the combustion-melting zone 5 in the region extending from the point about 15 m from the ignition furnace 4 to the BTP as the sintering progressed. That is, an electric current was passed to the individual magnetic floating apparatuses while controlling the gap between the magnetic pole ends and the surface of the sintered cakes to 30 mm, and increasing continuously the electric current to the individual magnetic floating apparatus from zero A at the position with a sintered cake layer thickness of 200 mm to 150 A at the position with a sintered cake layer thickness of 600 mm, thereby applying to the sintered cakes a magnetic force corresponding to the load of the sintered cakes resulting from the increasing sintered cake layer thickness in the region extending from the point about 15 m from the ignition furnace 4 to the BTP.

Usually, the thickness of the sintering bed from the ignition furnace 4 is decreased by shrinkage as the sintering progresses and the sintering bed is shrunk by about 100 mm at a point near the sintered ore discharge section, whereas the shrinkage of this example was about 48 mm.

As a result, as shown in FIGS. 11(*a*) to 11(*d*), where a case in which no magnetic force was applied is plotted by and a case in which magnetic force was applied is plotted by ○, the productivity was improved by 9% and the yield was also improved by 1.2% in the case in which magnetism was applied, as compared with the case in which no magnetism was applied. Furthermore, the reduction susceptibility was improved by 8% and a good particle size distribution was obtained. Thus, the qualities were improved.

EXAMPLE 3

The same magnetic floating type apparatus for use in a sintering operation was used in this example as was used in Example 1. During the sintering operation carried out in the same DL sintering machine in the same manner as in Example 1, magnetic floating apparatuses 6-1 to 6-5 as shown in FIG. 4 were provided at a distance of 1 m in a region extending from a point about 15 m from the ignition furnace 4 (temperature at a level of 240 mm from the surface of the sintered cakes: 600° C.; thickness of the sintered cakes: 200 mm) to the BTP, about 50 m from the ignition furnace 4, as shown in FIG. 3. As shown in FIG. 10(*d*), sintering was carried out while reducing the load of the sintered cakes on the combustion-melting zone.

That is, sintering was carried out without passing an electric current to the magnetic floating apparatuses 6-1 to 6-2 in the region from the sintered cake layer thickness of zero mm to that of 200 mm, and then an electric current of 300 A was passed to the magnetic floating apparatuses 6-1 to 6-2 in the region from the sintered cake layer thickness of 200 mm, that is, the region extending from about 20 m from the ignition furnace 4, thereby applying to the sintered cakes a magnetic force (700 kg/m$^2$) larger than the resultant force (i.e. a total of the blower suction pressure and the load of the sintered cakes) to peel the sintered cakes off the sintering bed situated below the sintered cakes. Then, an electric current of 100 A was passed to the individual magnetic floating apparatuses 6-3 to 6-5 while controlling the gap between the magnetic pole ends and the surface of the sintered cakes to 20 mm in the region from the sintered cake layer thickness of 400 mm to that of 600 mm, i.e. the region extending from the point of peeling of the sintered cakes to the BTP, thereby applying to the peeled sintered cakes a magnetic force (700 kg/m$^2$) corresponding to the resultant force from the blower suction pressure and the load of the peeled sintered cakes. Thus, sintering was carried out while maintaining the peeled sintered cakes in a floating state.

Usually, the thickness of the sintering bed from the ignition furnace 4 is decreased by shrinkage as the sintering progresses and the sintering bed is shrunk by about 100 mm at a point near the sintered ore discharge section, whereas shrinkage of this example was about 20 mm.

As a result, as shown in FIGS. 11(*a*) to 11(*d*), where a case in which no magnetism was applied is plotted by and a case in which magnetism was applied is plotted by □, the productivity was improved by 9% and the yield was at the same level in the case in which magnetism was applied, as compared with the case in which no magnetism was applied. Usually an increase in the productivity lowers the yield, and thus the yield was substantially improved considering the corresponding increase in the productivity. Furthermore, the reducibility was improved by 7%, and a good particle size distribution was obtained. Thus, the qualities were considerably improved.

EXAMPLE 4

The same magnetic floating type apparatus for use in a sintering operation was used in this example as was used in Example 1. During the sintering operation in the same DL sintering machine with a sintering bed thickness of 600 mm at a suction pressure of 1,600 mm aq. created by the blower, magnetic floating apparatuses 6-1 to 6-5, shown in FIG. 4, were provided at a distance of 1.0 m from a region extending from a point about 20 m from the ignition furnace 4 (temperature at a level of 200 mm from the surface of the sintered cakes: 600°; thickness of the sintered cakes: 180 mm) to the BTP, about 50 m from the ignition furnace 4, as shown in FIG. 3. As shown in FIG. 12(*b*), sintering was carried out while maintaining the load of the sintered cakes on the combustion-melting zone 5 at zero in a given region.

That is, sintering was carried out without passing an electric current to the magnetic floating apparatus 6-1 to 6-2 in the region from the sintered cake layer thickness of 0 mm to that of 180 mm, and then an electric current of 160 to 330 A was passed to the individual magnetic floating apparatuses 6-3 to 6-5 while controlling the gap between the magnetic pole ends and the surface of the sintered cakes to 30 mm in the region from the sintered cake layer thickness of 180 mm to that of 600 mm, that is, the region from a point about 20 m from the ignition furnace 4 to the BTP, thereby preventing peeling of the sintered cakes form the combustion-melting zone and the layer of raw materials. Thus, sintering was carried out while applying to the sintered cakes formed by sintering a magnetic force corresponding to the resultant force (560 to 1,200 kg/m$^2$) from the blower suction pressure on the combustion-melting zone 5 and the load of the sintered cakes, thereby making the resulting force on the combustion-melting zone 5 zero.

Usually, the thickness of the sintering bed from the ignition furnace 4 is decreased by shrinkage as the sintering progresses and the sintering bed is shrunk by about 100 mm at a point near the sintered ore discharge section. It was found that the shrinkage of this example was about 35 mm. The sintering results are shown in FIGS. 13(*a*) to 13(*h*), where "base (full load)" means a case where only a resultant force form the blower suction pressure and the weight of formed sintered cakes was applied on the combustion-melting zone without any application of a magnetic force, as shown in FIG. 12(*a*); "half load" means a case where the resultant force on the combustion-melting zone was reduced to about one half by application of a magnetic force, as shown in FIG. 12(*c*); and "no load" means a case where sintering was carried out while making the resultant force on the combustion-melting zone 5 zero in this Example.

As shown in FIGS. 13(*a*) to 13(*h*), the productivity was increased by approximately 30% in the case in which a magnetic force was applied, as compared with the case in which no magnetic force was applied. This seems to be the largest effect of this Example. The yield was on the same level as in the case in which no magnetic force was applied, but usually an increase in the productivity lowers the yield. Thus, the yield is substantially improved considering the corresponding increase in the productivity. In addition, the reducibility was improved by 8%, and a sharp particle size distribution was obtained and uniform particle sizes were obtained. Thus, the qualities were considerably improved. The sintering time was shortened from 47 minutes to 34 minutes, and the hourly production per unit air consumption was increased from 2.74 (t/h/m$^2$)/Nm$^3$, while the sintering shrinkage was decreased from 115 mm to 35 mm and total NOx generation was reduced by 30%. Further, although the coke combustion speed was increased by about 2 times, there was no change in the combustion effects. Hourly generation of NOx was very low. In addition, SOx generation had an increasing tendency, but was more concentrated toward the sintered ore discharge section.

In FIGS. 13(*a*) to 13(*h*), the effect was gradually improved from the full load situation to the half load situation, and from the half load situation to the no load situation. That is, better effects were obtained by decreasing the load. In view of the load conditions, it was found that the magnetic floating effect was significant in the present invention.

EXAMPLE 5

During the sintering operation in a DL sintering machine with a sintering area of 600 m$^2$ (5 m wide×120 m in the strand length) and a sintering bed thickness of 600 mm at a suction pressure of 1,800 mm aq., magnetic floating apparatuses 6-1 to 6-5 shown in FIG. 7 were provided at a distance of 1.5 m in a region extending from a point about 20 m from the ignition furnace 4 to the BTP 8 about 100 m from the ignition furnace 4, as shown in FIG. 3, and an electric current was passed to the individual magnetic floating apparatuses to float the sintered cakes. Usually, the thickness f the sintering bed from the ignition furnace 4 is decreased by shrinkage as the sintering progresses and the sintering bed is shrunk by about 150 mm at a point near the sintered ore discharge section. The shrinkage of this Example was found to be about one half of the norm. The productivity was improved from 35 t/d/m$^2$ to 42 t/d/m$^2$.

EXAMPLE 6

During the sintering operation in a DL sintering machine with a sintering area of 280 m$^2$ (4 m wide×70 m long) and an ordinary sintering bed thickness of 500 mm at a suction pressure of 1,800 mm aq., magnetic floating apparatuses 6-1 to 6-5 shown in FIG. 7 were provided at a longitudinal distance of 1.5 mm in a region from a point 20 m from the ignition furnace 4 to the BTP 8 50 m from the ignition furnace 4 to conduct the sintering operation while floating the sintered cakes. As result, the speed of downward movement of the combustion-melting zone was greatly celebrated, and even where the sintering bed thickness was ultimately increased to 650 mm, productivity was not reduced. With the increase in the sintering bed thickness, the yield was improved from 82% to 87%, coke consumption per ton of sintered product was reduced by about 3 kg, and gas consumption per ton of sintered product was reduced by 0.5 Nm$^3$.

EXAMPLE 7

3 minutes after ignition to start sintering in a GW sintering machine with a sintering area of 21 m$^2$ (3 m wide×7 m long( and a sintering bed thickness of 500 mm at a suction pressure of 1,200 mm aq., magnetic floating apparatuses 6-1 to 6-5 shown in FIG. 8 were provided above a pan for sintering tests, and sintering was carried out while floating the sintered cakes. As a result, it was found that the yield was not lowered and the productivity was improved from 30 t/d/m$^2$ to 35 t/d/m$^2$.

EXAMPLE 8

A caterpillar type magnetic floating apparatus for use in a sintering operation as shown in FIGS. 9(*a*) and 9(*b*) was used. During the sintering operation in the same DL sintering machine as was used in Example 1 with a sintering bed thickness of 600 mm at a blower suction pressure of 1,600 mm aq., a set of magnets was rotatably and movably provided in the longitudinal direction of the sintering machine in a region extending from a point about 20 m from the ignition furnace 4 (temperature at a level of 240 mm from the surface of the sintered cakes: 600° C.; thickness of the sintered cakes: 220 mm) to the BTP about 50 m from the ignition furnace 4, so that the set of magnetic constituting the lower run 22-1 of a caterpillar may confront a set of pallets.

In this example, sintering was carried out in a mode as shown in FIG. 10(*d*) while reducing the weight of the sintered cakes on the combustion-melting zone 5. That is, sintering was carried out without passing an electric current to the magnets in the region from the sintered cake layer thickness of 0 mm to that of 220 mm, and an electric current of 300 A was passed to the magnets in the region from the sintered cake layer thickness of 220 mm, that is, the region from a point about 20 m from the ignition furnace 4, thereby applying to the sintered cakes a larger magnetic force (700 kg/m$^2$) than the resultant force form the blower suction pressure on the combustion-melting zone 5 and the load of the formed sintered cakes, so as to peel the sintered cakes from the sintering bed disposed below the sintered cakes.

Then, the magnetic filed was applied to the peeled sintered cakes and then the magnetized magnets proceeded in the longitudinal direction while attracting the peeled sintered cakes toward the magnets. Then, an electric current of 30 A was passed to the magnets in a region from the sintered cake layer thickness of 220 mm to that of 600 mm, i.e. the region from the point of peeling completion to the BTO, to make the gap between the magnetic pole ends and the surface of the sintered cakes zero, thereby carrying out sintering while maintaining the peeled sintered cakes in a floating state due to attraction to the magnets. When the magnets 11 of the lower run 22-1 of the caterpillar were changed to the upper run 22-2 of the caterpillar by rotation and movement thereof, the passage of electric current to the magnetic coils 9 of the magnets 11 was discontinued, thereby making the magnets 11 proceed along the upper run 22-2 without having a magnetic filed applied thereto. In this manner, the magnetic floating force was controlled.

The productivity was improved by 12% in the case in which the magnetic force was applied, as compared with the case in which no magnetic force was applied, but the yield was found to be at the same level as in the case in which no magnetic force was applied. Usually an increase in the productivity lowers the yield, and thus the yield was substantially improved considering the corresponding increase in the productivity. The reducibility was improved by 6%, and a good particle size distribution and uniform particle sizes were obtained. Thus, the qualities were considerably improved.

EXAMPLE 9

During the sintering operation in a DL sintering machine with a sintering area of 600 $m^2$ (5 m wide × 120 m long) with a sintering bed thickness of 600 mm at a suction pressure of 1,500 mm aq., magnetic floating apparatuses 6-1 to 6-5 shown in FIG. 4 were provided at a distance of 1.5 m in a region extending from a point about 20 m from the ignition furnace 4 to the BTP 8 about 110 m from the ignition furnace 4, as shown in FIG. 3, and an electric current was passed to the magnetic floating apparatus 6-1 so as to develop a floating force larger than the load resulting from the pressure loss down to the combustion-melting zone and the load of the sintered cakes at a position 30 m from the ignition furnace 4, and at a suction pressure of 1,500 mm aq., thereby floating the sintered cakes. Then, sintering was carried out with such a floating force as to enable supporting of the load of the sintered cakes in the successive magnetic floating apparatuses 6-2 to 6-5.

Effects of the operational improvements are shown in Table 1. The productivity was improved from 30 t/d/$m^2$ to 37 t/d/$m^2$, and the yield was not lowered in spite of the increase in the productivity. The reducibility was increased from 67 to 72 according to JIS-RI. The NOx generation was slightly reduced in spite of the increase in the productivity. Results of a conventional operation for improving the permeability by decreasing the thickness of the sintering bed to increase the productivity are also shown in Table 1.

TABLE 1

| | | Ordinary operation | Operation by the invention | Conventional operation for improving the productivity |
|---|---|---|---|---|
| Operating conditions | Bed thickness (mm) | 600 | 600 | 500 |
| | magnetic peeling | none | done | none |
| Results of operation | Productivity (t/d/$m^2$) | 30.0 | 37 | 36 |
| | yield (+5 mm %) | 84.2 | 85.7 | 81.7 |
| | Strength (JIS SI, +10 mm %) | 90.1 | 90.1 | 87.6 |
| | Reducibility (JIS RI value) | 67.5 | 72.3 | 68.1 |
| | NOx (ppm) | 204 | 197 | 209 |

EXAMPLE 10

The sintering operation was carried out in a DL sintering machine with a sintering area of 280 $m^2$ (4 m wide × 70 m long) with an ordinary sintering bed thickness of 500 mm at a suction pressure of 1,000 mm aq., but the size of the grain of the raw materials became finer, so that productivity could not be maintained. Then, magnetic floating apparatuses 6-1 to 6-5 were provided in the longitudinal direction at a distance of 1.5 m in a region extending from a point 20 m far the ignition furnace 4 to the BTP 8, a point about 50 m from the ignition furnace 4, as shown in FIG. 3. An electric current was passed to the magnetic floating apparatus 6-1 so as to develop a larger floating force than the load resulting from the pressure loss down to the combustion-melting zone and the load of the sintered cakes at a position 20 m from the ignition furnace 4 at a suction pressure of 1,000 mm aq., thereby floating the sintered cakes, and sintering was continued while floating the sintered cakes. The results are shown in Table 2. As shown in Table 2, downward movement of combustion-melting zone was greatly accelerated and the productivity could be recovered without any decrease in the yield. Expensive quick lime was inevitably added in the conventional method so as to ensure the production, whereas in the present invention sintering could be carried out without any addition of such quick lime.

TABLE 2

| | | Ordinary operation | Operation with raw materials with finer grains | Operation by the invention | Conventional improved operation |
|---|---|---|---|---|---|
| Operating conditions | Bed thickness (mm) | 500 | 480 | 500 | 500 |
| | Quick lime | 0 | 0 | 0 | 1.5 |
| | Magnetic peeling | none | none | done | none |
| Results of operation | Productivity (t/d/$m^2$) | 40.5 | 37.3 | 41.2 | 39.4 |
| | Yield (+5 mm %) | 85.6 | 85.1 | 86.3 | 85.7 |
| | Strength (JIS SI +10 mm %) | 89.8 | 89.7 | 89.9 | 89.9 |
| | Reducibility (JIS RI value) | 68.2 | 68.4 | 72.2 | 69.3 |
| | NOx (ppm) | 193 | 206 | 191 | 193 |

EXAMPLE 11

The same magnetic floating type apparatus for use in a sintering operation was used in this example as was used in Example 1. The sintering bed thickness and the blower suction pressure were changed as shown in Table 3 to conduct sintering with no load in the DL sintering machine in the same manner as in Example 4, thereby examining the novel sintering process according to the present invention.

TABLE 3

| Sintering bed thickness (mm) | | | 400 | 600 | 800 |
|---|---|---|---|---|---|
| Suction pressure (mm aq.) | 1,000 | magnet force applied | — | | |
| | | no magnet force | ○ | ○ | — |
| | 2,000 | magnet force applied | — | | |
| | | no magnet force | — | □ | — |

Results are shown in FIGS. 14(*a*) to 14(*e*), where ○ shows a case in which no magnetic force was applied at a suction pressure of 1,000 mm aq., shows a case in which a magnetic force was at a suction pressure of 1,000 mm aq.; □ shows a case in which no magnetic force was applied at a suction pressure of 2,000 mm aq., and shows a case in which a magnetic force was applied at a suction pressure of 2,000 mm aq.

As shown in FIG. 14(*a*), the sintering operation can be carried out at a suction pressure of 1,000 mm aq. when magnetic floating is applied to a large scale sintering machine operable at a suction pressure of 2,000,, aq. A main blower provided with VVVF (Variable Voltage Variable Frequency) usually requires 20 kW/ton-sinter, and thus 8 kW/tons-sinter can be reduced by using the present invention. However, 3 kW/ton-sinter is required for the magnetic floating apparatuses.

First, as shown in FIG. 14(*b*), it is known that an increase in the sintering bed thickness can increase the yield, but the bed thickness can never be increased beyond about 600 mm owing to a bottleneck accruing in the permeability. According to the present invention, sintering can be carried out with a sintering bed thickness greater than 700 mm, which has been difficult with the conventional method. The yield can be also improved by maximum 5%.

In addition, as shown in FIG. 14(*c*), it seems that the yield per sintering time (that is, under a constant productivity condition) is improved over that in the conventional method.

Further, as shown in the illustration of particle size distribution of FIG. 14(*d*), the effects of obtaining uniform particles sizes which is a general characteristic of the magnetic floating sintering process can be obtained, and at the same time the average particle size can be widely changed according to the sintering bed thickness. Conventionally, there has been no way of freely changing the particle sizes. It seems that a novel sintering operation combined with a blast furnace is possible.

From a combination of the diagram of FIG. 14(*e*) showing NOx generation per ton of sintered ores with the diagram of FIG. 14(*a*) showing the productivity, it is apparent that NOx generation can be considerably reduced when the present magnetic floating apparatus are used for producing the same amount of sintered ores.

What is claimed is:

1. A method for performing a sintering operation based on a downward air suction flow, comprising:

igniting a layer of raw materials to initiate sintering in an upper level region thereof;

after initiation of sintering in the upper level region of the layer of raw materials, applying a magnetic field to create a magnetic floating force which acts on a sintering-completed portion of the upper level region of the layer of raw materials; and allowing the sintering to continue while applying the magnetic field to create the magnetic floating force.

2. An apparatus for use in a sintering operation, comprising:

a sintering machine including a pallet, an ignition furnace mounted relative to said pallet, and a discharge section;

a magnetic floating apparatus including at least one magnet having a magnetic pole end;

a mounting frame mounting said at least one magnet above said pallet with said magnetic pole end directed toward said pallet;

a gap sensor for measuring the size of a gap between said magnetic pole end and the surface of a sintering-completed portion when the sintering-completed portion is disposed in said pallet;

a magnet level controller for controlling the size of the gap; and wherein said magnetic floating apparatus and said gap sensor are provided longitudinally along said sintering machine in a magnetizing region defined between an outlet of said ignition furnace and an inlet to said discharge section.

3. An apparatus for use in a sintering operation, comprising:

a sintering machine including a plurality of pallets, an ignition furnace mounted relative to said pallets, and a discharge section;

a magnetic floating apparatus including a plurality of magnets, each having magnetic pole ends;

a mounting frame mounting said magnets above said pallets;

a gap sensor for measuring the size of a gap between said magnetic pole ends and the surface of a sintering-completed portion when the sintering-completed portion is disposed in said pallets;

a magnet level controller for controlling the size of the gap; and wherein said magnetic floating apparatus and said gap sensor are provided longitudinally along said sintering machine in a magnetizing region defined between an outlet of said ignition furnace and an inlet to said discharge section.

4. A method according to claim 1, wherein the magnetic field is applied to the sintering-completed portion from a time when the temperature of the sintering-completed portion has become not more than 600° C. at a depth of 50 to 150 mm from the surface of the sintering-completed portion.

5. A method according to claim 4, wherein the magnetic field is applied to the sintering-completed portion from a time when the temperature of the sintering-completed portion has come within a range of room temperature to 500° C. at a depth of 50 to 150 mm from the surface of the sintering-completed portion.

6. A method according to claim 1, wherein the magnetic floating force is adjusted by controlling an electric current through an electromagnetic coil and a gap size between a magnetic pole end and the surface of a sintering bed.

7. A method according to claim 1, wherein the magnetic field is applied to the sintering-completed portion so that the magnetic floating force acts on the sintering-completed portion with a magnitude of not more than a resultant force of the weight of the sintering-completed portion and a downward force on the sintering-completed portion due to a blower suction pressure.

8. A method according to claim 1, wherein the magnetic field is applied to the sintering-completed portion so that the magnetic floating force increases in correspondence with increases in the weight of the sintering-completed portion due to increases in the thickness of the sintering-completed portion caused by progression of the sintering through the layer of raw materials.

9. A method according to claim 1, wherein the magnetic field is applied to the sintering-completed portion so that the magnetic floating force has a magnitude equal to the resultant force of the weight of the sintering-completed portion and a downward force on the sintering-completed portion due to a blower suction pressure, to thereby allow the sintering to continue with the sintering-completed portion in a load-free state.

10. A method according to claim 7, wherein, in applying the magnetic field, an electric current through an electromagnetic coil is controlled while a gap of 10 to 50 mm is maintained between a magnetic pole end of the magnet and the surface of the sintering-completed portion.

11. A method according to claim 1, wherein the magnetic field is applied when the progress of the sintering is such that the sintering-completed portion has attained a given thickness; and the magnetic field is applied so that the magnetic floating force acting on the sintering-completed portion is greater in magnitude than a resultant force of the weight of the sintering-completed portion and a downward force on the sintering-completed portion due to a blower suction pressure, to thereby peel the sintering-completed portion from a sintering bed situated below the sintering-completed portion and maintain the sintering-completed portion in a floating state as the sintering progresses.

12. A method according to claim 11, wherein the sintering-completed portion is peeled from the sintering bed when the sintering-completed portion attains a thickness ranging from 1/5 to 5/5 of the thickness of the layer of raw materials.

13. A method according to claim 11, wherein the sintering-completed portion is peeled from the sintering bed when the sintering-completed portion attains a thickness ranging from 200 to 400 mm.

14. A method according to claim 11, wherein the sintering-completed portion is peeled from the sintering bed when the temperature of the sintering-completed portion is brought into a range of room temperature to 500° C. at a depth of 50 to 150 mm from the surface of the sintering-completed portion.

15. A method according to claim 11, wherein as the sintering progresses a gap of 10 to 50 mm is maintained between a magnetic pole end of the magnet and the surface of the sintering-completed portion and an electric current through the electromagnetic coil is controlled.

16. A method according to claim 11, wherein an electric current through an electromagnetic coil is controlled while zero gap is maintained between a magnetic pole end of the magnet and the surface of the sintering-completed portion.

17. A method according to claim 1, wherein the magnetic field is applied to at least one of an upper side and both lateral sides of the sintering-completed portion.

18. An apparatus according to claim 2, further comprising a controller to which a necessary magnetic floating force for the position of at least one of said at least one magnet in the longitudinal direction of the sintering machine is input as data to enable selection of individual magnetization patterns, and which computes an electric current from a set electromagnetic force and the gap to control an electric current to the magnet through a main power source, thereby controlling the set electromagentic force and also controlling the gap size by the magnet level controller, so as to control the magnetic floating force.

19. An apparatus according to claim 2, wherein said at least one magnet comprises at least one of an electromagnetic, a permanent magnet, a superconducting magnet, and a compound magnet.

20. An apparatus according to claim 3, further comprising a controller to which a necessary magnetic floating force for the position of at least one of said magnets in the longitudinal direction of the sintering machine is input as data to enable selection of individual magnetization patterns, and which computes an electric current from a set electromagnetic force and the gap to control an electric current to the magnet through a main power source, thereby controlling the set electromagnetic force, and applying a magnetic field to the sintering-completed portion by passing an electric current through magnets consituting the rotatable caterpillar belt are transferred along a lower run of the caterpillar belt opposite the pallets by rotation, and then discontinuing the passage of the electric current to the electromagnetic coils of the magnets when the magnets reach the discharge section and the magnets on the lower run of the caterpillar belt are transferred to an upper run of the caterpillar belt by rotation, such that the magnets proceed along the upper run in such a manner that the magnets do not apply a magnetic field to the sintering-completed portion.

21. A method according to claim 8, wherein, in applying the magnetic filed, an electric current through an electromagnetic coil is controlled while a gap of 10 to 50 mm is maintained between a magnetic pole end of the magnet and the surface of the sintering-completed portion.

22. A method according to claim 9, wherein, in applying the magnetic field, an electric current through an electromagnetic coil is controlled while a gap of 10 to 50 mm is maintained between a magnetic pole end of the magnet and the surface of the sintering-completed portion.

* * * * *